US008713766B2

(12) United States Patent
Wiman

(10) Patent No.: US 8,713,766 B2
(45) Date of Patent: May 6, 2014

(54) DEVICE FOR USE IN SEWING

(76) Inventor: Lena Wiman, Upplands Vasby (SE)

( * ) Notice: Subject to any disclaimer, the term of this patent is extended or adjusted under 35 U.S.C. 154(b) by 329 days.

(21) Appl. No.: 12/811,404

(22) PCT Filed: Dec. 30, 2008

(86) PCT No.: PCT/SE2008/000751

§ 371 (c)(1),
(2), (4) Date: Sep. 15, 2010

(87) PCT Pub. No.: WO2009/084996

PCT Pub. Date: Jul. 9, 2009

(65) Prior Publication Data

US 2011/0005049 A1 Jan. 13, 2011

(30) Foreign Application Priority Data

Jan. 2, 2008 (SE) ..... 0800008

(51) Int. Cl.
*B26B 11/00* (2006.01)
*B26B 29/02* (2006.01)

(52) U.S. Cl.
USPC ..... 26/27; 26/7; 7/161; 30/DIG. 8

(58) Field of Classification Search
CPC ..... A41H 31/005; D05B 89/00; B26B 27/00; B26B 27/007; B26B 29/00; B26B 29/02; B26B 11/00; A61B 17/0467
USPC ..... 28/170, 171, 146; 26/7, 10.4, 11, 27, 26/28; 112/282, 285, 125, 129; 15/104.05, 15/110, 244.1, 236.01; 7/158, 161, 162, 7/121; 223/101; 83/936; 30/DIG. 8, 294, 30/298, 151, 164, 123, 287, 143
See application file for complete search history.

(56) References Cited

U.S. PATENT DOCUMENTS

| | | | | | |
|---|---|---|---|---|---|
| 117,588 | A | * | 8/1871 | Woods | 7/138 |
| 191,569 | A | * | 6/1877 | Clark | 30/294 |
| 208,459 | A | * | 10/1878 | Budlong | 30/294 |
| 322,299 | A | * | 7/1885 | Lavigne | 7/158 |
| 593,461 | A | * | 11/1897 | Darmody | 7/161 |
| 598,732 | A | * | 2/1898 | Leonard | 7/170 |
| 764,064 | A | * | 7/1904 | Minter | 7/161 |
| 865,126 | A | * | 9/1907 | Rosing | 7/161 |
| 1,097,614 | A | * | 5/1914 | Courtland | 30/289 |

(Continued)

FOREIGN PATENT DOCUMENTS

| | | |
|---|---|---|
| FR | 1213667 | 4/1960 |
| GB | 794904 | 5/1955 |

*Primary Examiner* — Amy Vanatta
(74) *Attorney, Agent, or Firm* — Dickstein Shapiro LLP

(57) ABSTRACT

A thread removal tool for getting rid of loose thread pieces, thread ends, etc. from textiles, fabric, cloth and the like, for example, after ripping open a previously produced seam, contains a thread removal head (3). The thread removal head can be located at one end of a shaft or a handle part (1) and is configured to take hold of loose thread pieces or thread fragments, without itself becoming attached to an underlying textile item, a piece of cloth or the like. The thread removal head can have an uneven surface, e.g., contain bumps (5), to grasp loose thread pieces and thread fragments. Furthermore, or alternatively, it can be made of or have a surface layer made of a material which has a certain sticking or fastening action on such loose thread pieces and thread fragments.

4 Claims, 4 Drawing Sheets

(56) References Cited

U.S. PATENT DOCUMENTS

Figure 6:
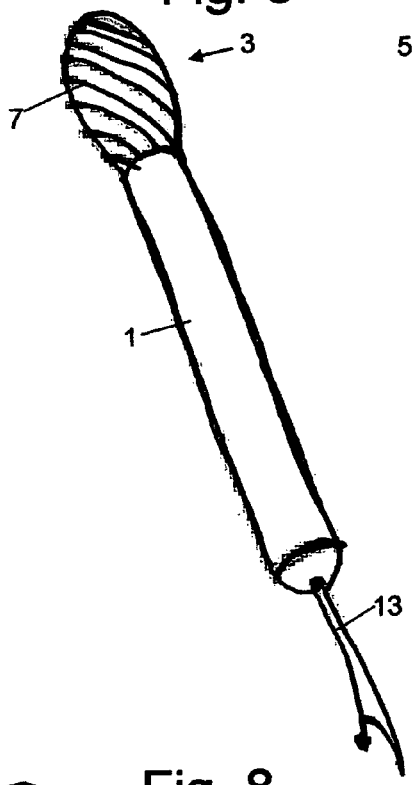

| | | | | | |
|---|---|---|---|---|---|
| 1,109,796 | A | * | 9/1914 | Sills | 294/25 |
| 1,351,010 | A | * | 8/1920 | Bell | 83/697 |
| 1,477,510 | A | * | 12/1923 | Martin | 30/287 |
| 2,249,378 | A | * | 7/1941 | Di Leo | 7/135 |
| 2,370,440 | A | * | 2/1945 | Beavin | 30/289 |
| 2,494,439 | A | * | 1/1950 | Gorka et al. | 7/121 |
| 2,597,564 | A | * | 5/1952 | Bugg | 30/298 |
| 2,651,840 | A | * | 9/1953 | Taylor | 30/151 |
| 2,693,641 | A | * | 11/1954 | Omoto | 30/294 |
| 2,710,448 | A | * | 6/1955 | Andrews | 30/162 |
| 2,966,691 | A | * | 1/1961 | Cameron | 15/104.94 |
| 3,330,077 | A | * | 7/1967 | Foster et al. | 451/557 |
| 3,363,276 | A | * | 1/1968 | Thomas, Jr. | 15/105 |
| 3,972,117 | A | * | 8/1976 | Fogg | 30/287 |
| 3,975,822 | A | * | 8/1976 | Mabus | 30/294 |
| 4,205,664 | A | * | 6/1980 | Baccialon | 601/141 |
| 4,299,208 | A | * | 11/1981 | Blanc | 601/141 |
| 4,527,575 | A | * | 7/1985 | Vasas | 132/218 |
| 4,545,393 | A | * | 10/1985 | Gueret et al. | 132/218 |
| 4,706,747 | A | * | 11/1987 | Schneider | 166/153 |
| 5,195,278 | A | * | 3/1993 | Grove | 451/524 |
| D383,307 | S | * | 9/1997 | Klein et al. | D4/105 |
| 6,901,622 | B2 | * | 6/2005 | Thompson et al. | 15/104.002 |
| 6,957,492 | B1 | * | 10/2005 | Westfall | 30/151 |
| 7,055,527 | B2 | * | 6/2006 | Tien | 132/75.6 |
| D620,958 | S | * | 8/2010 | Tipton et al. | D15/126 |
| 7,958,583 | B1 | * | 6/2011 | Heffner | 7/158 |
| 2004/0154172 | A1 | | 8/2004 | Tatz | |

* cited by examiner

Fig. 1
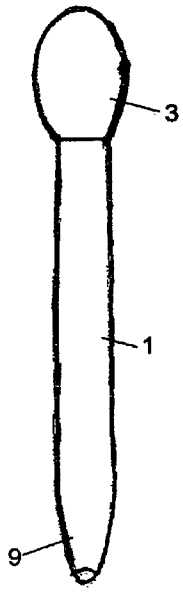
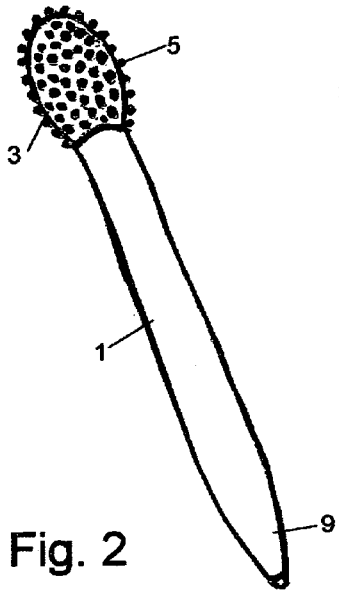
Fig. 2
Fig. 3
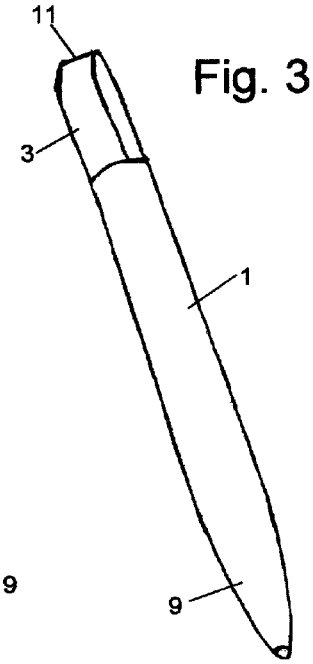
Fig. 4
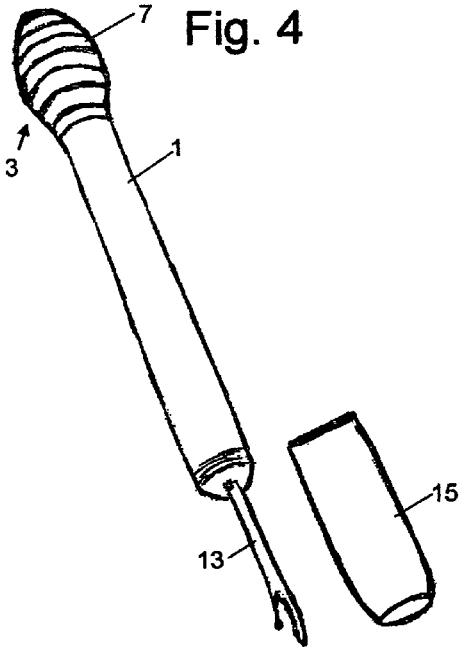
Fig. 5
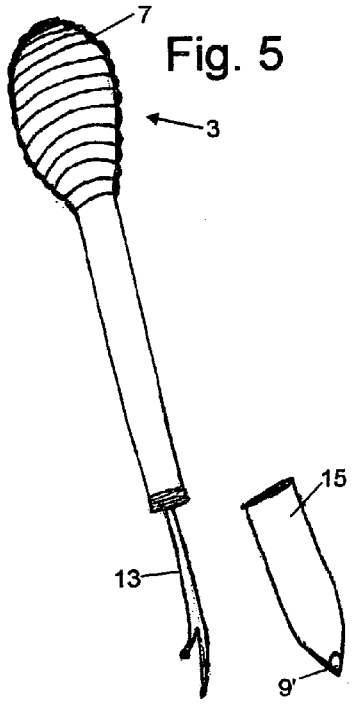

DEVICE FOR USE IN SEWING

RELATED APPLICATION

This application claims the priority and benefits of Swedish patent application No. 0800008-5, filed on 2 Jan. 2008, whose entire technical content is incorporated here as a reference.

TECHNICAL FIELD

The present invention concerns a device for use in sewing, especially a thread removal tool, i.e., a remover of loose thread pieces, "thread tails", thread ends and thread fragments.

BACKGROUND

After one has stitched a seam in a cloth or a fabric and then has unstitched the seam, e.g., when the seam was defective in some way or because the seam was only needed during a preliminary stage of the sewing of an article of clothing, thread tails will remain in the fabric. Of course, these must be removed. But it is often difficult and time-consuming to remove such thread tails with one's fingers.

DESCRIPTION OF THE INVENTION

One aim of the invention is to specify an effective remover to get rid of the thread pieces and remnants, e.g., after ripping a stitch open.

One thread remover for help in removal of thread ends and the like, such as after ripping open a stitch, contains a thread removal head which is designed to take hold of or become attached to the loose thread pieces when the thread remover is moved along the surface of a textile item, a piece of cloth, or the like, so that the surface of the thread removal head is in contact with the surface of the textile item or piece of cloth. The engaging with the surface shall be such that the thread removal head itself is not attached to the textile item, piece of cloth, or the like. In particular, the thread removal head can have a geometrical shape adapted to this purpose and/or be made of a material specially chosen for this purpose. The thread removal head can have a geometrical shape with a surface having prominences or irregularities and inner regions lying within these, which can help in the grasping of the thread pieces. The irregularities can be, for example, grooves or bumps. Alternatively, or at the same time as such a configuration, the thread removal head can be made of a material such as a plastic material, which can somehow attach to thread ends without the thread sticking or adhering to the head or, on the other hand, without the thread removal head sticking or attaching to the cloth.

A thread remover of this kind makes it quick and easy to remove the thread pieces, e.g., after ripping open a seam already stitched.

The thread remover can comprise a shaft, at whose first end is situated a thread removal head. The other opposite end can have a pointed shape for removal of certain more firmly anchored thread tails or to lead the cloth along during the stitching instead of a person having to have their fingers in proximity to the needle when he or she is sewing at the machine. This can be used, for example, when sewing patchwork quilts, where it is often necessary to sew rather small pieces of cloth and short stretches, and the person doing the sewing must be especially careful not to injure their fingers.

The thread remover can be used both in the home and the factory.

In addition or instead, there can be a tool at the other end of the shaft, such as an unstitching tool. The unstitcher can be protected by a protective cap designed with a pointed end to be used in the same way as the second end with pointed shape per the above.

FIGURE DESCRIPTION

Figure 7:
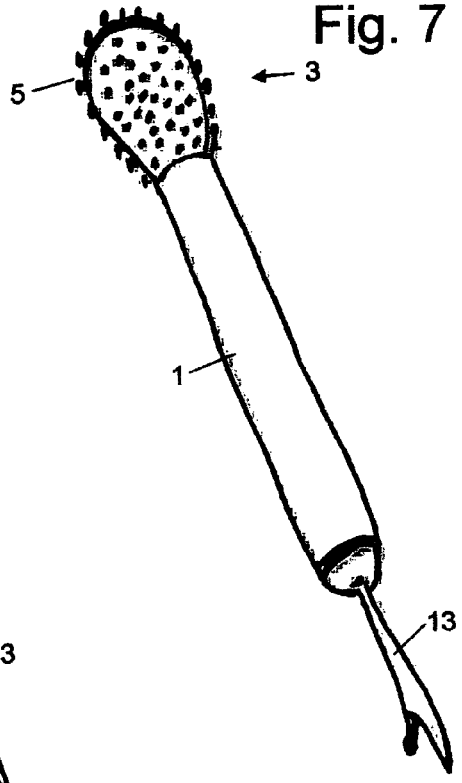
Figure 8:
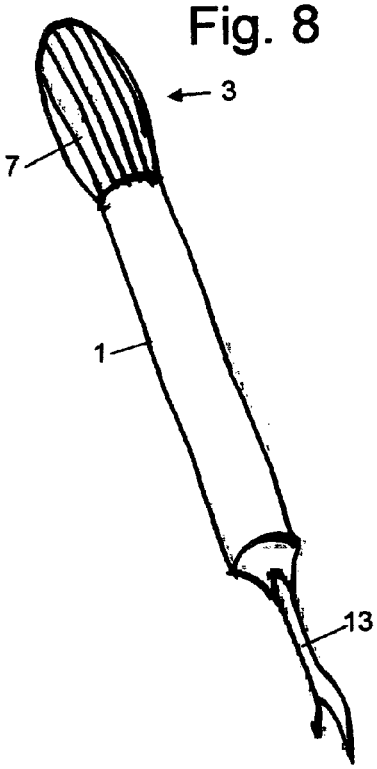
Figure 9:
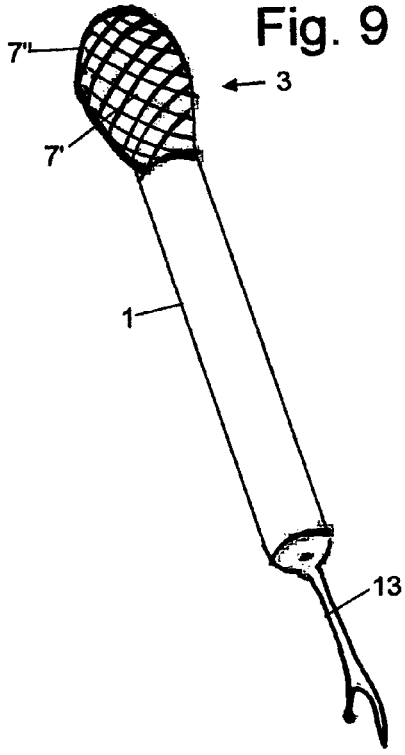
Figure 10:
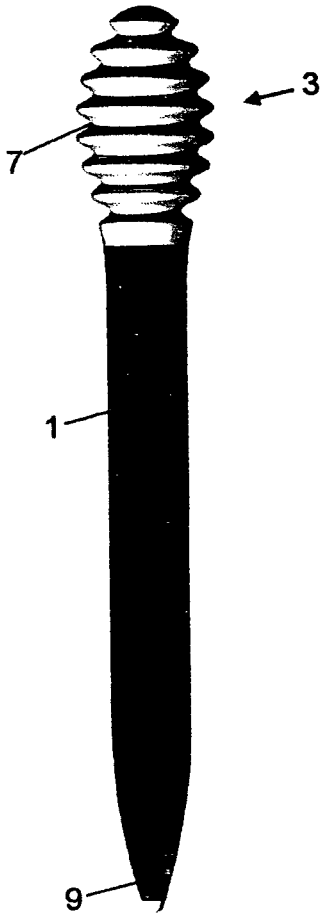
Figure 11:
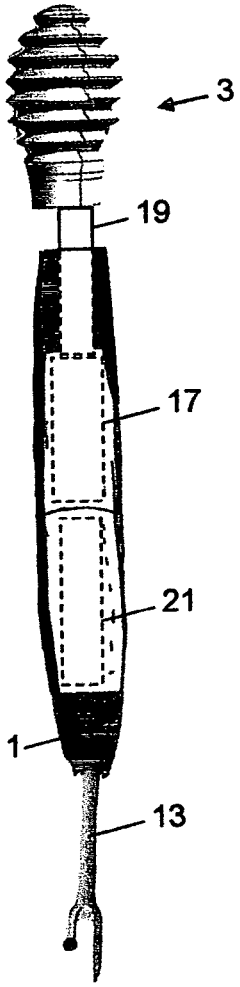
Figure 12:
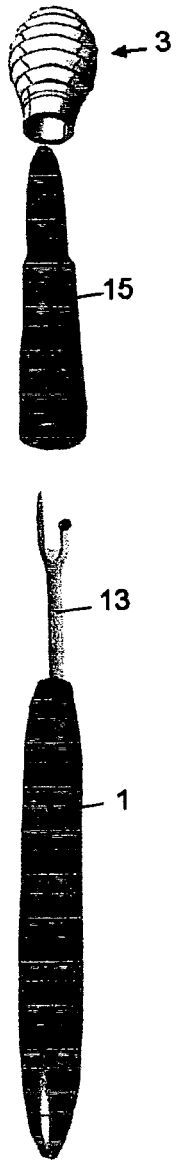
Figure 13B:
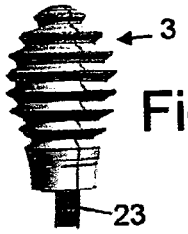
Figure 13A:
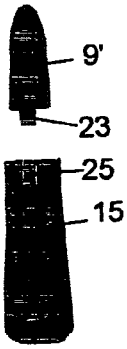
Figure 13C:
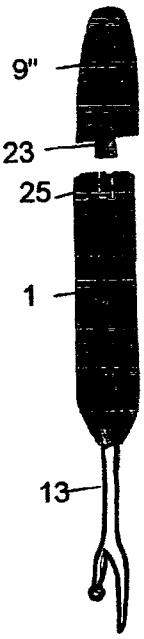

The invention shall now be described as a nonlimiting sample embodiment with regard to the enclosed drawings, where:

FIG. 1 is a picture of a thread remover in a basic design with totally level or flat thread removal head, FIG. 2 is a picture similar to FIG. 1 of a thread remover with a thread removal head having bumps, FIG. 3 is a picture similar to FIG. 1 of a thread remover with a flattened thread removal head, FIG. 4 is a picture similar to FIG. 1 of a thread remover with a thread removal head having grooves and with an unstitching tool that can be protected by a removable cap, FIG. 5 is a picture similar to FIG. 1 but with a removable cap with pointed end, FIG. 6 is a picture of a thread remover similar to FIGS. 4 and 5 but without cap and having a thread removal head with slanted grooves, FIG. 7 is a picture similar to FIG. 6 but with a thread removal head having bumps, FIG. 8 is a picture similar to FIG. 6 but with a thread removal head having lengthwise grooves, FIG. 9 is a picture similar to FIG. 6 but with a thread removal head having two groups of slanted grooves, FIG. 10 is a side view of one practical embodiment of a thread remover, FIG. 11 is a schematic picture of a thread remover with rotatable, motor-driven thread removal head, FIG. 12 is a picture of a thread remover with a thread removal head designed to be firmly attached to a protective cap, and FIGS. 13*a*, 13*b* and 13*c* are side views of a thread remover designed as a set of various parts.

DETAILED DESCRIPTION

FIG. 1 shows a thread remover. It contains, as its basic parts, a shaft 1 and a thread removal head 3. The thread removal head is situated at one end of the shaft and in the embodiment shown it has a generally round shape or a shape with rotational symmetry and in particular the shape of an ellipsoid, whose main axis, also being the major axis of the corresponding ellipse, also lies on the axis of the shaft. Thus, the axis of the rotationally symmetrical shape coincides with the lengthwise axis of the shaft. The mathematical ratio between the minor axis and the major axis of said ellipsoid can be in the range of 1:1 to 1:3 and especially around 1:2. The shaft 1 can be designed as a round stick with diameter somewhat less than the minor axis of the ellipse, so that the thread removal head juts out from the shaft, viewed in the lengthwise direction of the shaft.

The thread removal head 3 can be made of a material which can "take hold of" or attach to loose thread ends and thread fragments without them becoming firmly stuck to the surface of the thread removal head and without the thread removal head becoming firmly stuck to the cloth. Such material can be a polymer or elastomer. For example, plastics of brand TP/U (thermoplastic of polyurethane type) or TP/E (thermoplastic of elastomer type) or general high-friction plastics can be used. Alternatively, only the surface layer of the thread removal head 3 need be made of such material.

In the embodiment per FIG. 1, the thread removal head 3 has a totally flat or totally level surface. Alternatively, the surface can be provided with irregularities, as shown in FIGS. 2 and 4-9. Such irregularities can make it easier for the thread removal head to make direct contact with the thread ends and also give the thread removal head a larger total surface area and thus larger working surface for the material in the thread removal head in the case when it is made from a material that "grips", as above. For example, the surface can be configured as a bumpy surface, see FIGS. 2 and 7, or as a grooved surface, see FIGS. 4, 5, 6, 8 and 9. The bumps 5, the space between them, the grooves or slots 7 and the space between them can have adapted characteristic dimensions, typically being in the range of 1-5 mm. The grooves or slots as shown in FIGS. 4 and 5 can lie in the circumferential direction about the common lengthwise axis of the shaft 1 and thread removal head 3, i.e., each groove or slot will lie in a plan perpendicular to the lengthwise axis. The grooves can also have a different orientation, such as in the lengthwise direction of the shaft 1, i.e., strictly speaking, lying in a plane passing through the lengthwise axis of the shaft, see FIG. 8, or they can also extend in helical manner over the thread removal head's surface with a suitable pitch angle, e.g., in the range between 45° and 60°, in relation to the lengthwise axis of the shaft, see FIG. 6. The grooves per FIGS. 4 and 5 can then be said to have a pitch angle of and the grooves per FIG. 8 a pitch angle of 90°. There can also be two groups of grooves 7', 7", see FIG. 9, so that grooves within each group extend basically parallel to each other and the grooves in one group make an angle, e.g., in the range between 75° and 105°, such as 90°, with the grooves of the other group. The thread removal head 3 can then have a diamond pattern of prominences with general rhomboid profile, which can correspond to bumps with, for example, an essentially square shape.

The end of the shaft 1 not carrying the thread removal head 3 can be shaped as a point 9, which can have a somewhat blunt outer end, see FIGS. 1, 2 and 3. The pointed part has basically the shape of a circular pyramid or cone. Such a tip can be used, for example, when not completely cut through thread ends have to be removed or when guiding and feeding cloth to a sewing machine head while sewing.

One practical embodiment is shown in FIG. 10. The thread removal head 3 has peripherally running grooves and slots 7, i.e., grooves and slots having a pitch angle of 0° per the above. The thread removal head's total length can be around 140 mm here, while the shaft part 1 has a diameter of 12 mm and the thread removal head 3 has a length of 35 mm and a maximum diameter of 21 mm. The number of slots 7 here is seven with a mutual spacing of around 5 mm, but of course a different number and spacing than that described can be used. Also, thread removal heads with substantially larger maximum diameter can often be suitable, e.g., with a maximum diameter around 30-35 mm.

When the thread removal head 3 has a basically rotationally symmetrical shape, as shown in, e.g., FIG. 1-2, a motor 17 can be arranged to rotate the thread removal head, see FIG. 11. The motor can then drive at relatively low speed about an axle 19, on which the thread removal head 3 is mounted. The motor is energised from a dry cell or battery 21, which is placed along with the motor 17 inside the shaft 1.

In the alternative configuration of thread removal head 3 shown in FIG. 3, it is not rotationally symmetrical but instead flattened and can have basically the shape of a somewhat elongated rectangular block terminating in a pointed edge 11. A cross section of the thread removal head in a plane through the lengthwise axis of the shaft 1 then corresponds to a rectangle, adjoined at one end by a triangle, i.e., one side of the triangle coincides with one side of the rectangle. For example, the triangle can be equilateral and then its base side can coincide with one side of the rectangle.

The end of the shaft 1 where the thread removal head 3 is not situated can alternatively be configured with some tool which can be used for unstitching. Thus, it is shown in FIGS. 4-9 that the other end of the shaft 1 bears a conventional unstitching tool (having a knife) 13, which can be concealed by a protective cap 15. The protective cap can have a point in the same way for the shaft itself per FIG. 1-3, as shown in FIG. 5, for example, in order to remove stubborn thread ends and guide the cloth per above. The protective cap 15 can be shaped such that when secured to the shaft 1 it constitutes an extension of the shaft itself.

The thread removal head 3 can also itself sit on the protective cap 15, see FIG. 12, while the shaft 1 is a self-standing unit, at whose first end a tool such as an unstitching tool 13 can be found, while its other opposite end can be shaped as a point 9 per the above. The unstitching tool can, as above, be concealed by the protective cap with thread removal head when this is placed at the first end of the shaft and be freely exposed when the protective cap is placed at the other end.

Moreover, it is possible to fashion the thread removal tool as a set of various parts, which can be put together and taken apart so that one can work as effectively as possible with the tool in every given situation. As is shown in FIGS. 13*a*-13*c*, the thread removal head 3 is a loose part having a projecting part or dowel 23. The dowel can be introduced into a corresponding cavity 25 in the entire end of the protective cap 15 and in one end of the shaft 1, so that the thread removal head is constantly present on the respective part. The shaft at its other end can have an unstitching tool 13. Instead of the thread removal head 3, a pointed part 9' or a thicker terminating part 9" with similar dowel 23 is removably fastened to the protective cap or shaft. If the thread removal head is then placed on the protective cap 15 and the terminating part 9" on the shaft 1, one obtains a tool per FIG. 12. If, instead, the thread removal head 3 is placed on the shaft 1 and the pointed part 9' on the protective cap, one obtains a tool per FIG. 5. The dowel 23 and cavities 25 are fashioned for a firm and constant connection, such as a snap connection or a bayonet connection.

We have described above a thread removal tool comprising combinations of a thread removal head and a shaft and in some cases a protective cap, with various configurations of thread removal head and shaft and protective cap. However, the invention will not be limited to these, but rather a person skilled in the art will see that many other combinations of configurations of and with different parts can easily be produced and therefore come within the scope of the invention.

The invention claimed is:

1. A thread removal tool for removing loose thread pieces or thread fragments from an underlying textile, fabric or cloth, after ripping open a previously sewn seam, said thread removal tool comprising:

a shaft having a first end and a second end;

an unstitching tool located at the first end of the shaft, wherein the unstitching tool includes a knife for cutting the previously sewn seam by pushing the shaft toward the seam; and a thread removal head, wherein the thread removal head has a surface which has irregularities in the form of bumps or grooves, for grasping the loose thread pieces or thread fragments without becoming attached to the underlying textile, fabric or cloth, wherein the surface of the thread removal head includes material that adheres to the thread pieces or thread fragments, and wherein the material that adheres to the thread pieces or fragments is selected from the group consisting of a thermoplastic of polyurethane type, a thermoplastic of elastomer type, and high-friction plastics, and wherein the thread removal tool further comprises a removable cap for covering the knife, and wherein the thread removal head is located on the removable cap.

2. A thread removal tool according to claim 1, wherein the thread removal head has peripherally running grooves or slots located over its entirety.

3. A thread removal tool according to claim 1, wherein the thread removal head has an elongated flattened shape with a terminating edge, which is perpendicular to a lengthwise direction of the thread removal head.

4. A thread removal tool according to claim 1, wherein the thread removal head is located at the second end of the shaft.

* * * * *

UNITED STATES PATENT AND TRADEMARK OFFICE

CERTIFICATE OF CORRECTION

PATENT NO. : 8,713,766 B2
APPLICATION NO. : 12/811404
DATED : May 6, 2014
INVENTOR(S) : Lena Wiman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 536 days.

Signed and Sealed this
Twenty-ninth Day of September, 2015

Michelle K. Lee

Michelle K. Lee
*Director of the United States Patent and Trademark Office*